US009770151B2

(12) United States Patent
Sun et al.

(10) Patent No.: US 9,770,151 B2
(45) Date of Patent: Sep. 26, 2017

(54) CLEANING APPLIANCE

(71) Applicant: Dongguan Pheaton Electronic Technology Co., Ltd., Dongguan, Guangdong province (CN)

(72) Inventors: Yungming Sun, Dongguan (CN); Shunqing Ye, Dongguan (CN); Linwen Yang, Dongguan (CN); Lanhua Tian, Dongguan (CN)

(73) Assignee: DONGGUAN PHEATON ELECTRONIC TECHNOLOGY CO., LTD., Dongguan, Guangdong Province (CN)

( * ) Notice: Subject to any disclaimer, the term of this patent is extended or adjusted under 35 U.S.C. 154(b) by 346 days.

(21) Appl. No.: 14/592,173

(22) Filed: Jan. 8, 2015

(65) Prior Publication Data

US 2016/0198918 A1 Jul. 14, 2016

(51) Int. Cl.
*A47L 5/30* (2006.01)
*A47L 9/04* (2006.01)

(52) U.S. Cl.
CPC ..... *A47L 9/0477* (2013.01); *A47L 5/30* (2013.01); *A47L 9/0444* (2013.01); *A47L 9/0455* (2013.01)

(58) Field of Classification Search
CPC ..... A47L 9/04; A47L 9/0444; A47L 9/0427; A47L 9/0455; A47L 9/0477; A47L 5/30; A47L 5/26; A47L 11/282; A47L 11/4016; A47L 7/0014; A47L 7/0009
See application file for complete search history.

(56) References Cited

U.S. PATENT DOCUMENTS 5,287,591 A * 2/1994 Rench ..... A47L 5/30 15/328
6,073,303 A * 6/2000 Hinojosa ..... A47L 5/30 15/384

FOREIGN PATENT DOCUMENTS

WO WO 2005/055795 A1 * 6/2005 ..... A47L 11/24

* cited by examiner

*Primary Examiner* — Laura C Guidotti
(74) *Attorney, Agent, or Firm* — Ming Chow; Sinorica, LLC

(57) ABSTRACT

The present invention relates to the technical field of cleaning, in particular to a cleaning appliance, which comprises a cleaning appliance body. The cleaning appliance body includes a housing, two brush rollers disposed at the bottom of the housing, a drive mechanism disposed in the housing and configured to drive the two brush rollers to rotate, and a dust collector disposed on the housing; a suction port of the dust collector is disposed between the two brush rollers; and both rotation directions of the two brush rollers direct towards the suction port. The cleaning appliance provided by the present invention adopts a combined structure of the two brush rollers and the dust collector; both rotation directions of the two brush rollers direct towards the suction port; dust, particulate waste or flocks are gathered; the waste is sucked into the dust collector through the suction port between the two brush rollers.

8 Claims, 9 Drawing Sheets

CLEANING APPLIANCE

FIELD OF THE INVENTION

The present invention relates to the technical field of cleaning, in particular to a cleaning appliance.

BACKGROUND OF THE INVENTION

The Chinese invention patent Application No. 200880121664.6 discloses a cleaning appliance, which comprises a substrate provided with a rotatable brush roller, a dirt container, a liquid container for receiving a cleaning solution, and a device for receiving contaminated cleaning solution, wherein the device is formed by sponge; the cleaning appliance comprises a handle portion; and the liquid container is disposed on the handle portion.

The traditional floor cleaning appliance cannot clean the floor at once; a great deal of dust is retained or dust is pushed towards one side to form a plurality of dust lines; or the cleaning process is repeated or a cleaning cloth cushion is washed for a plurality of times; or two or more than two appliances are used for cleaning. Therefore, the floor cleaning appliance is extremely inconvenient in the process of floor cleaning, is time-consuming and labor-consuming, and cannot completely clean up dust, particulate waste or flocks.

SUMMARY OF THE INVENTION

The objective of the present invention is to overcome the defects in the prior art and provide a cleaning appliance which can clean up neatly and has high working efficiency.

The present invention adopts the technical proposal that: the present invention relates to a cleaning appliance, which comprises a cleaning appliance body; the cleaning appliance body includes a housing, two brush rollers disposed at the bottom of the housing, a drive mechanism disposed in the housing and configured to drive the two brush rollers to rotate, and a dust collector disposed on the housing; a suction port of the dust collector is disposed between the two brush rollers; and both rotation directions of the two brush rollers direct towards the suction port.

Wherein, the two brush rollers are a first brush roller and a second brush roller which are parallel to each other; two rows of brushes are fixed on outer walls of both the first brush roller and the second brush roller; and the two rows of brushes of each brush roller are wavy and arranged opposite to each other.

Wherein, the housing includes an upper housing and a lower housing; a first brush roller mounting groove is recessed upwards in a central section of the lower housing; the first brush roller is disposed in the first brush roller mounting groove; a second brush roller mounting portion is projected upwards at a front end of the upper housing; a second brush roller mounting port is disposed at a front end of the lower housing; a central section of the second brush roller is disposed in the second brush roller mounting port; the top of the second brush roller is disposed in the second brush roller mounting portion;

a first left roller shaft and a first right roller shaft are respectively projected at both ends of the first brush roller; a first clamping projection is respectively disposed at one end of the first left roller shaft and one end of the first right roller shaft; a first recess is respectively disposed at both ends of the first brush roller; the first clamping projection is clamped into the first recess; the other end of the first left roller shaft and the other end of the first right roller shaft are respectively rotationally connected to both ends of the first brush roller mounting groove;

a second left roller shaft and a second right roller shaft are respectively projected at both ends of the second brush roller; a second clamping projection is respectively disposed at one end of the second left roller shaft and one end of the second right roller shaft; a second recess is respectively disposed at both ends of the second brush roller; the second clamping projection is clamped into the second recess; and the other end of the second left roller shaft and the other end of the second right roller shaft are respectively rotationally connected to both ends of the second brush roller mounting port.

Wherein, the drive mechanism includes a first motor and an actuating mechanism; the actuating mechanism includes an output gear fixed at an output end of the first motor, a first gear fixed on the first right roller shaft, a reverse gear engaged with the first gear, a duplicate gear fixed coaxially with the reverse gear, a second gear fixed on the second right roller shaft, a first belt connected between the output gear and the duplicate gear, and a second belt connected between the duplicate gear and the second gear;

the duplicate gear includes a first single gear and a second single gear; the diameter of the first single gear is greater than that of the second single gear; the first single gear and the output gear are transmissibly connected with each other through the first gear; and the second single gear and the second gear are transmissibly connected with each other through the second belt.

Wherein, a first motor cover is covered at one end of the first motor; a first protrusion is respectively fixed on both sides of the first motor cover; a first holder is fixed at a position of the top of the lower housing, corresponding to the first protrusion, and is provided with a first clamping groove engaged with the first protrusion; the first protrusion is clamped with the first clamping groove;

a first left bearing support and a first right bearing support are respectively sleeved on outer walls of the first left roller shaft and the first right roller shaft; a first left fixing groove and a first right fixing groove are respectively disposed at both ends of the first brush roller mounting groove; the first left bearing support and the first right bearing support are respectively embedded into the first left fixing groove and the first right fixing groove; a first left fixing plate is fixed at the bottom of the first left fixing groove; a receiving groove is disposed on one side of the first right fixing groove; the first gear is embedded into the receiving groove; a first right fixing plate is fixed at the bottom of the receiving groove and the first right fixing groove;

a second left bearing support and a second right bearing support are respectively sleeved on outer walls of the second left roller shaft and the second right roller shaft; a second left fixing groove and a second right fixing groove are respectively disposed at both ends of the second brush roller mounting port; the second left bearing support and the second right bearing support are respectively embedded into the second left fixing groove and the second right fixing groove;

the reverse gear and the duplicate gear are fixedly connected with each other through a connecting shaft; a third left bearing support is sleeved on an outer wall of the connecting shaft and disposed between the reverse gear and the duplicate gear; the other end of the connecting shaft runs through the duplicate gear and is extended; a third right bearing support is sleeved on an outer wall of an extension of the connecting shaft; a third left fixing groove and a third right fixing groove are respectively disposed on the top of the lower housing, corresponding to the third left bearing support and the third right bearing support; and the third left bearing support and the third right bearing support are respectively embedded into the third left fixing groove and the third right fixing groove.

Wherein, the dust collector includes a second motor, a fan fixed at an output end of the second motor, a filter connected to one end of the fan, a dust collection bucket being sleeved on the outside of the filter and having a hollow inner structure, and a dust collection handle disposed on the outside of the dust collection bucket and communicated with the inside of the dust collection bucket.

Wherein, a second motor cover is covered at one end of the second motor; a second protrusion is respectively fixed on both sides of the second motor cover; a second holder is fixed at a position of the top of the lower housing, corresponding to the second protrusion, and is provided with a second clamping groove engaged with the second protrusion; the second protrusion is clamped with the second clamping groove; a washer is sleeved at one end of the second motor cover;

a dust collection bucket holder is fixed at one end of the dust collection bucket; one end of the dust collection bucket and one end of the fan are respectively fixed at both ends of the dust collection bucket holder;

a dust collection bucket mounting port is disposed in a central section of the upper housing; a dust collection bucket is disposed in the dust collection bucket mounting port; a fan mounting portion and a second motor mounting portion are projected in the central section of the upper housing; the top of the fan is disposed in the fan mounting portion; the fan mounting portion is cambered; a plurality of vents are uniformly formed on a surface of the fan mounting portion; the top of the second motor is disposed in the second motor mounting portion;

the filter includes a fixing portion and an extension projected at one end of the fixing portion; an annular groove engaged with the fixing portion is disposed at one end of the dust collection bucket; the outside of the fixing portion is embedded into the annular groove; a plurality of strip holes are uniformly formed on an outer wall of the extension; and a filter ring is sleeved at a connection between the fixing portion and the extension.

Wherein, the dust collection handle is in the shape of a clothes hanger; a first connecting portion is projected on the top of the dust collection handle and provided with a connecting groove; a second connecting portion is projected on an outer wall of the dust collection bucket; the bottom of the first connecting portion is inserted into the connecting groove; the first connecting portion and the second connecting portion have a hollow inner structure respectively and are communicated with each other;

the dust collection handle includes an upper dust collection handle and a lower dust collection handle; a third clamping projection is respectively fixed on the left, the rear and the right of the lower dust collection handle; a third clamping groove engaged with the third clamping projection is respectively disposed on the left, the rear and the right of the upper dust collection handle; the third clamping projection is clamped with the third clamping groove; the suction port is formed between front ends of the lower dust collection handle and the upper dust collection handle; and an arc gap is disposed at a front end of the upper dust collection handle.

Wherein, a handle connector for mounting the handle is disposed at the rear of the upper hosing; and a roller wheel is disposed at a front end of the bottom of the lower housing.

Wherein, a cushion body is disposed at the rear of the bottom of the lower housing and is a cloth cushion or a paper cushion; and the cloth cushion is a steam spray cloth cushion, a water spray cloth cushion or a disinfecting fluid spray cloth cushion.

The present invention has the advantages that: the cleaning appliance provided by the present invention adopts a combined structure of the two brush rollers and the dust collector; both rotation directions of the two brush rollers direct towards the suction port; dust, particulate waste or flocks are gathered; the waste is sucked into the dust collector through the suction port between the two brush rollers; and hence the one-time rapid and neat cleaning effect can be achieved. Moreover, dust, other particulate waste or flocks on the floor are all cleaned at once and dust lines will not be retained on the floor, so that the labor intensity can be greatly reduced.

The cleaning appliance provided by the present invention can be widely applied in electrical floor cleaning appliances, can become an independent cleaning appliance, and can also be combined into a two-in-one cleaning appliance with an appliance with steam spray floor washing function. The appliance with the steam spray floor washing function and the cleaning appliance provided by the present invention can be simultaneously or independently used. The cleaning appliance provided by the present invention can also be combined into a two-in-one cleaning appliance with an appliance with high-temperature steam, water or other disinfecting fluid spray floor washing function. The appliance with the high-temperature steam, water or other disinfecting fluid spray floor washing function and the cleaning appliance provided by the present invention can be simultaneously or independently used. The cleaning appliance provided by the present invention can also be combined into a cleaning appliance with a cloth cushion or a paper cushion.

DETAILED DESCRIPTION OF THE PREFERRED EMBODIMENTS

Figure 1:
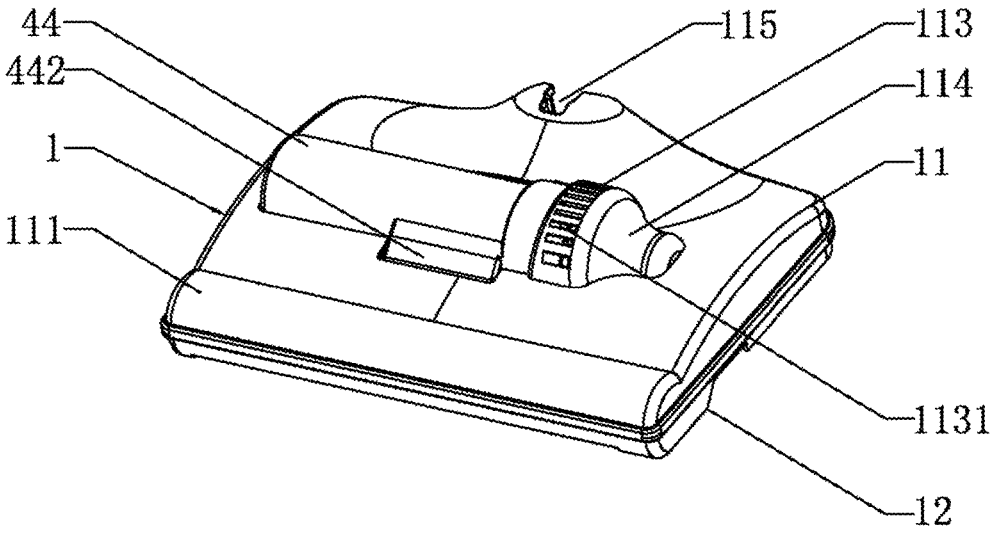
FIG. 1 is a schematic structural perspective view of a cleaning appliance provided by the present invention.
Figure 2:
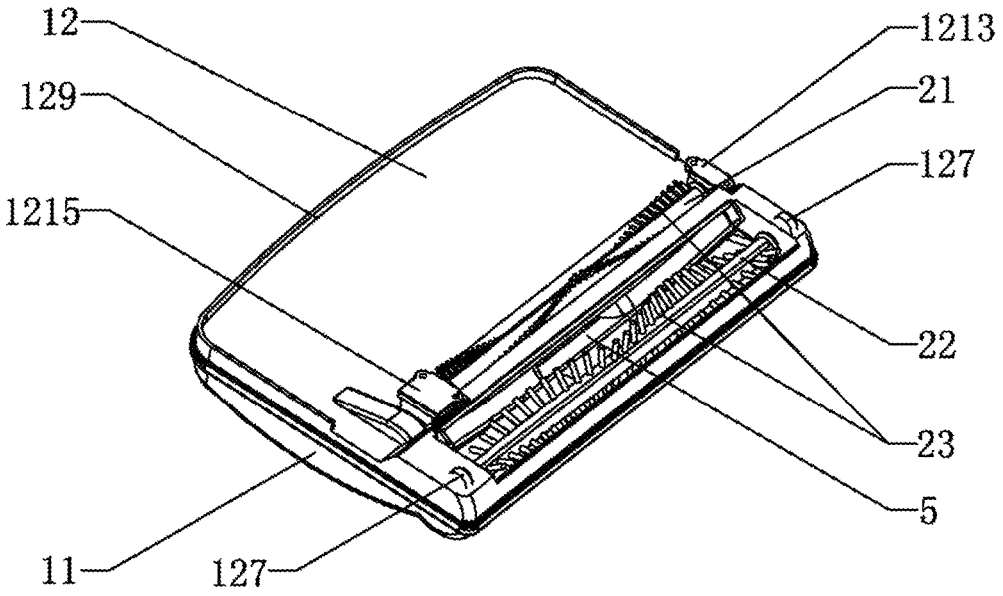
FIG. 2 is a schematic structural perspective view of the cleaning appliance provided by the present invention in another aspect of view.
Figure 3:
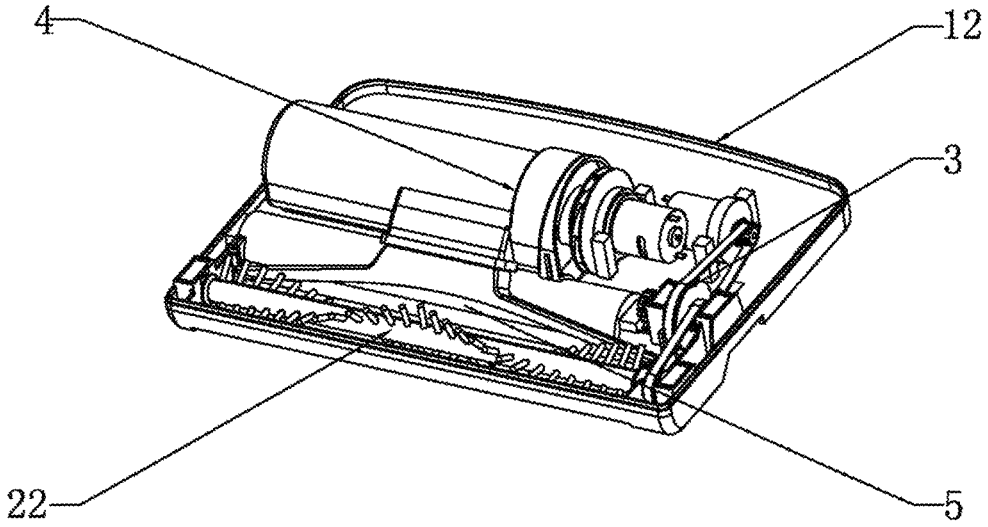
FIG. 3 is a schematic structural perspective view of the cleaning appliance provided by the present invention obtained after an upper housing is removed.
Figure 4:
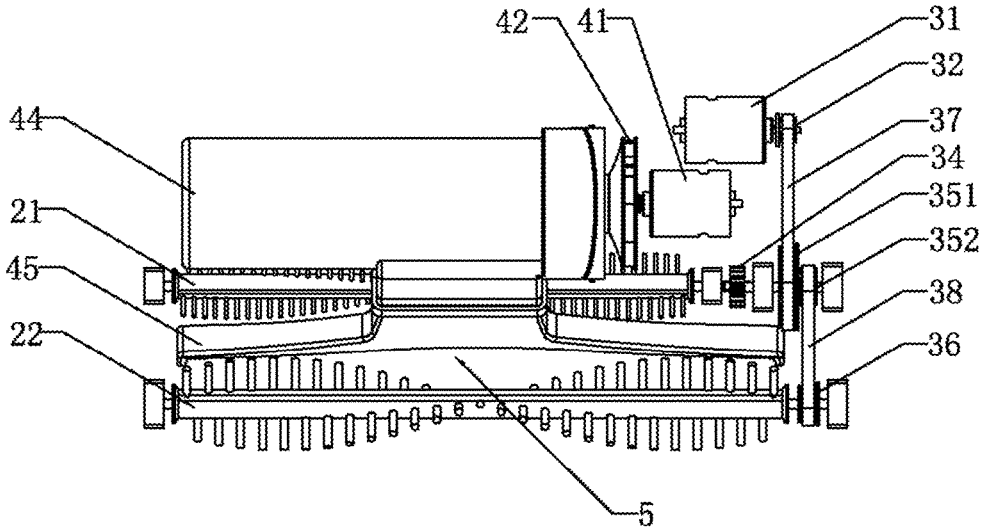
FIG. 4 is a top view of the cleaning appliance provided by the present invention obtained after a housing is removed.
Figure 5:
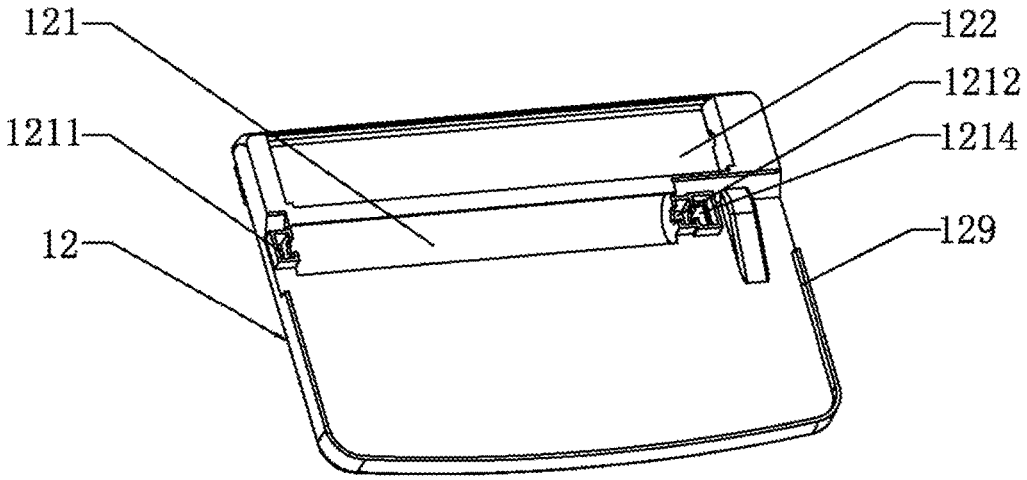
FIG. 5 is a schematic structural perspective view of a lower housing of the cleaning appliance provided by the present invention.
Figure 6:
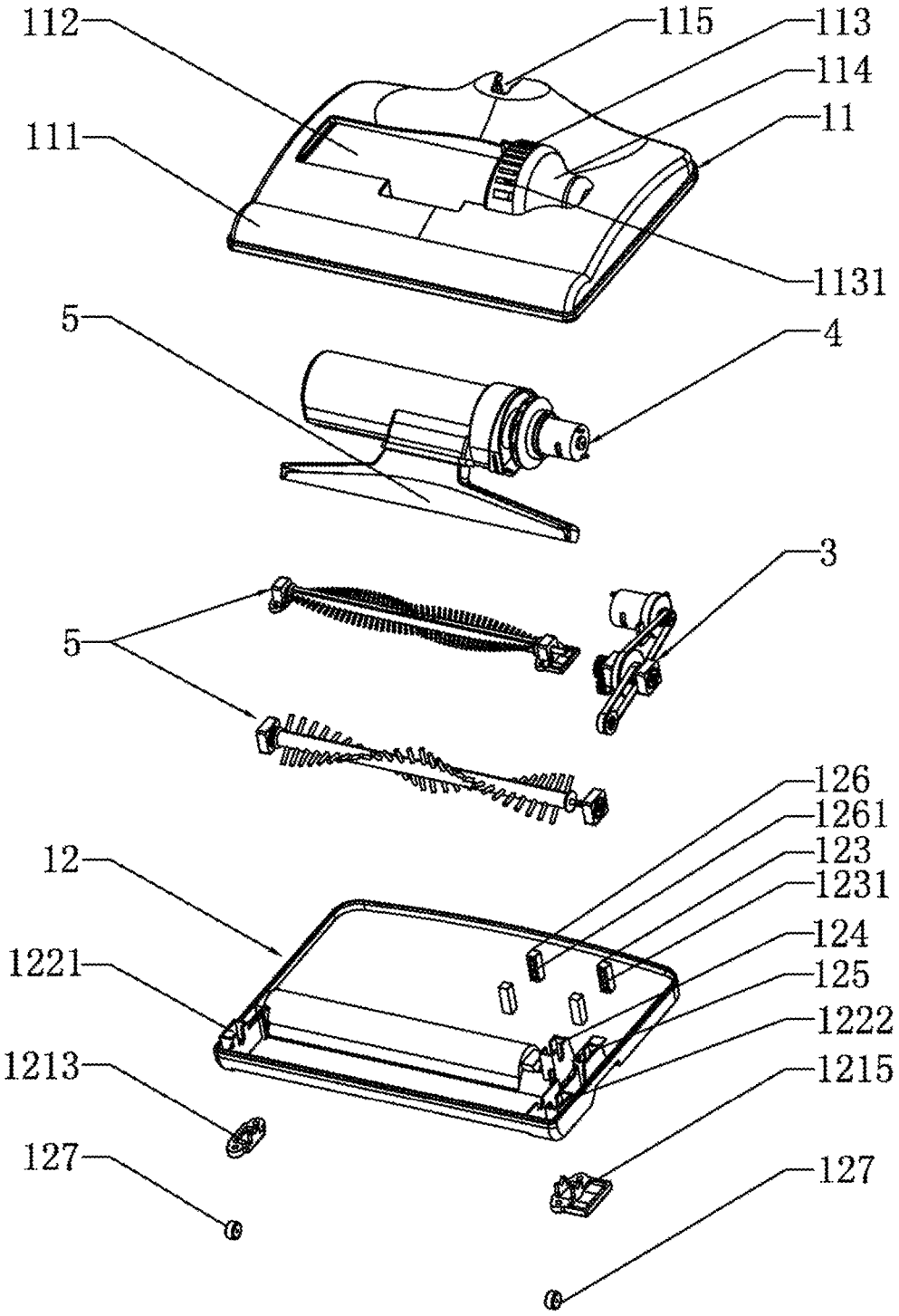
FIG. 6 is a schematic structural perspective exploded view of the cleaning appliance provided by the present invention.
Figure 7:
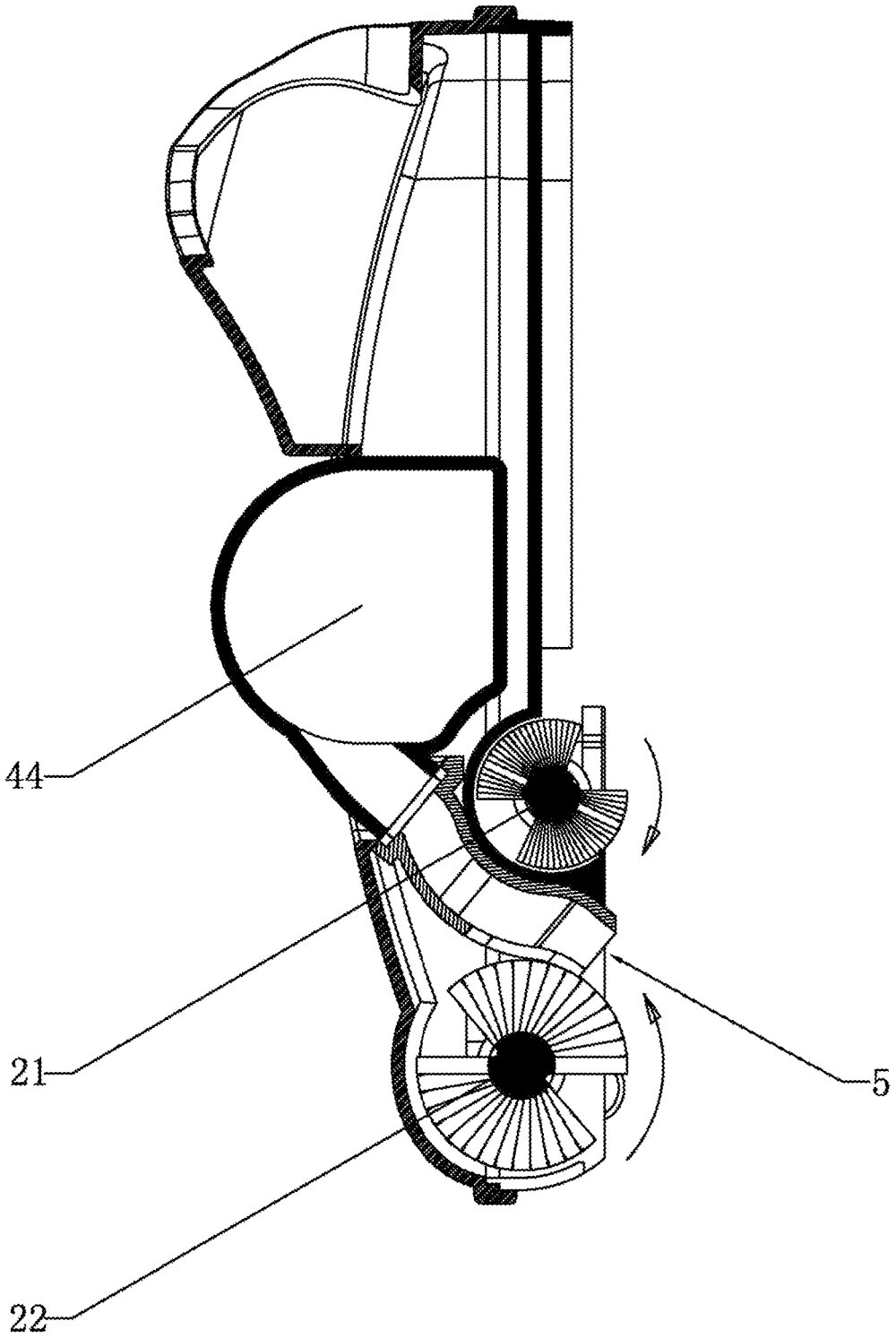
FIG. 7 is a sectional view of the cleaning appliance provided by the present invention.
Figure 8:
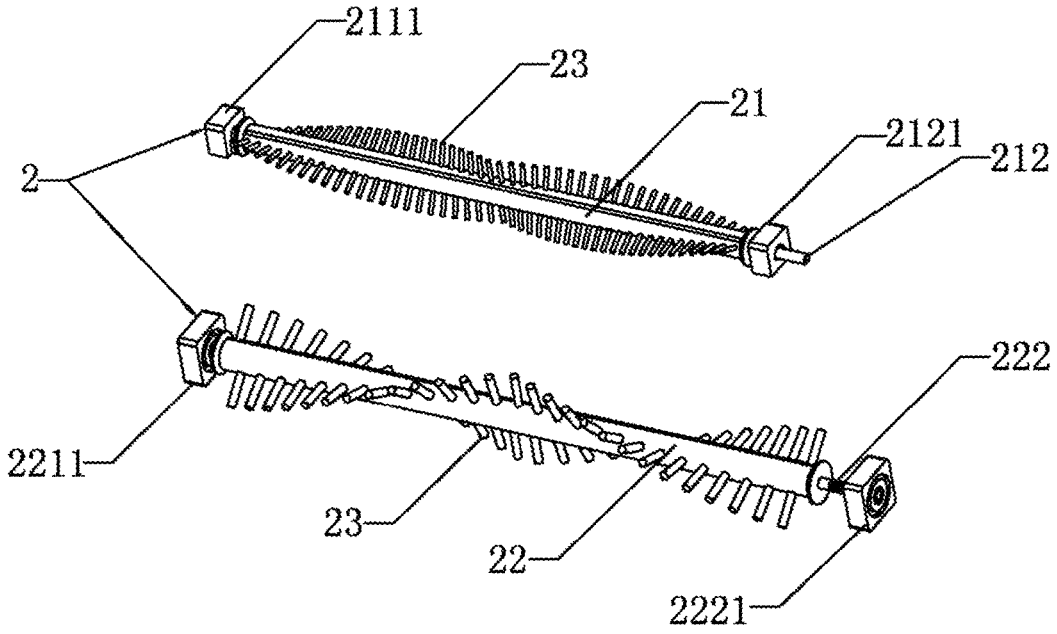
FIG. 8 is a schematic structural perspective view of brush rollers of the cleaning appliance provided by the present invention.
Figure 9:
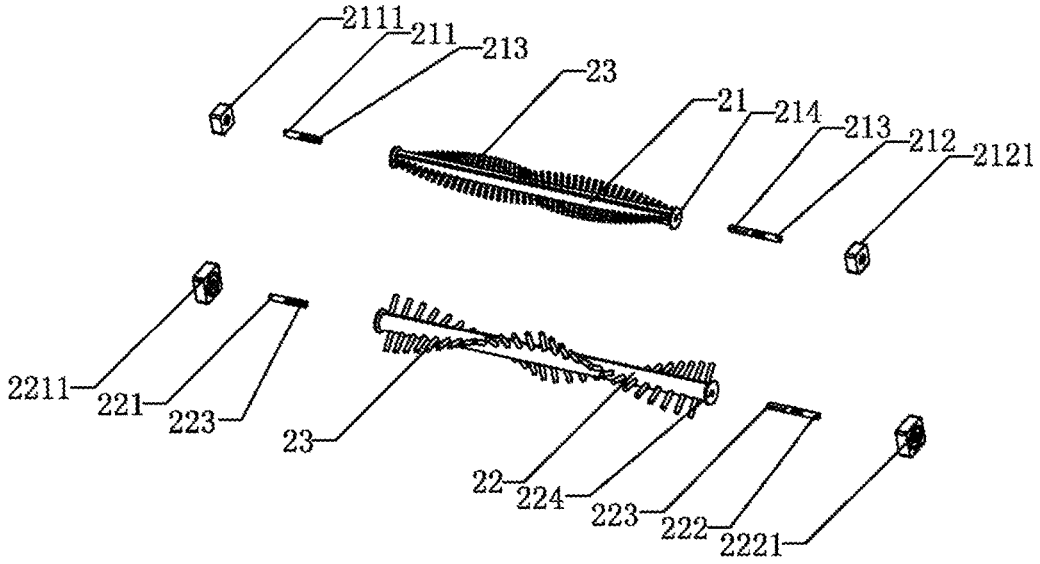
FIG. 9 is a schematic structural perspective exploded view of the brush rollers of the cleaning appliance provided by the present invention.
Figure 10:
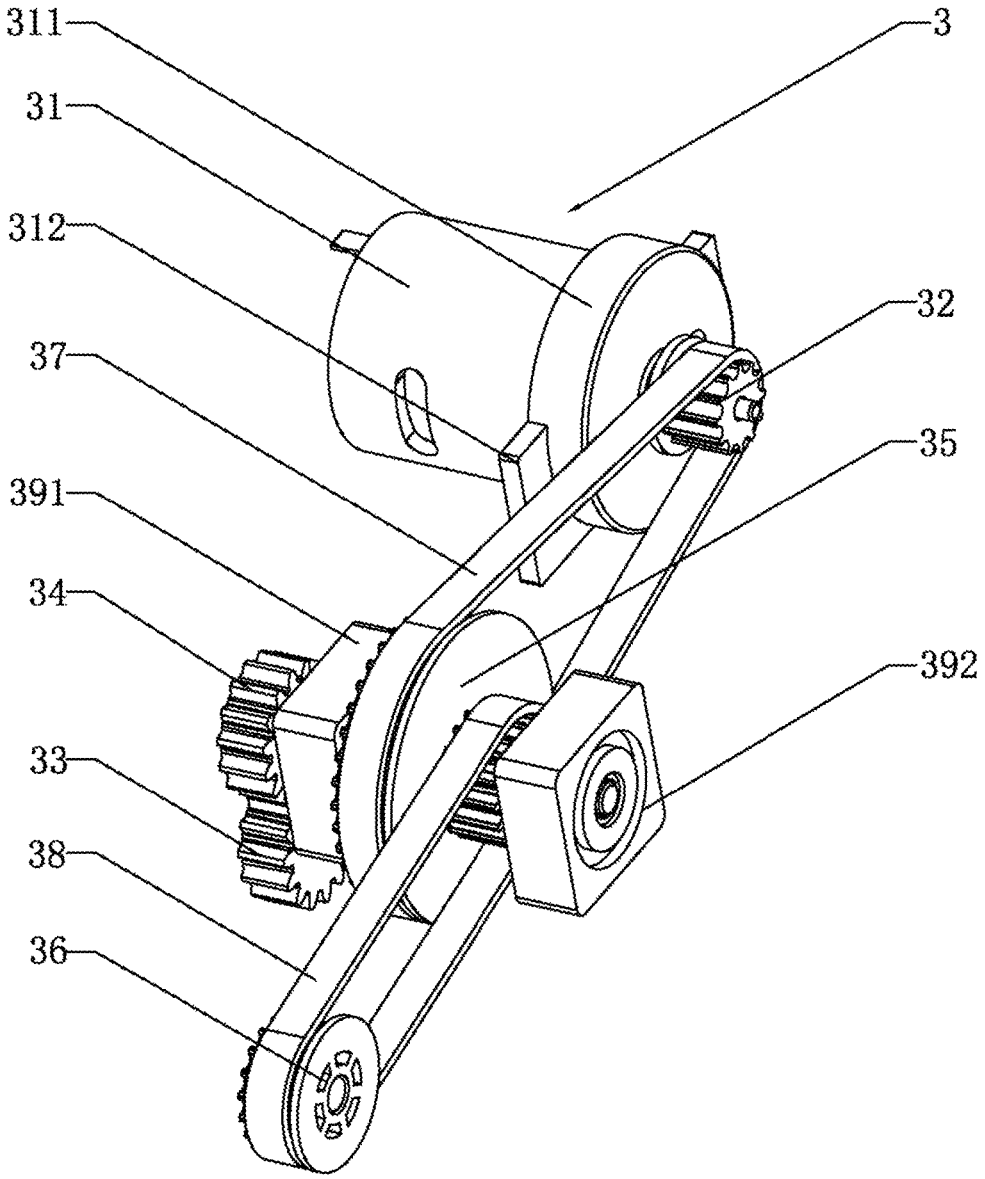
FIG. 10 is a schematic structural perspective view of a drive mechanism of the cleaning appliance provided by the present invention.
Figure 11:
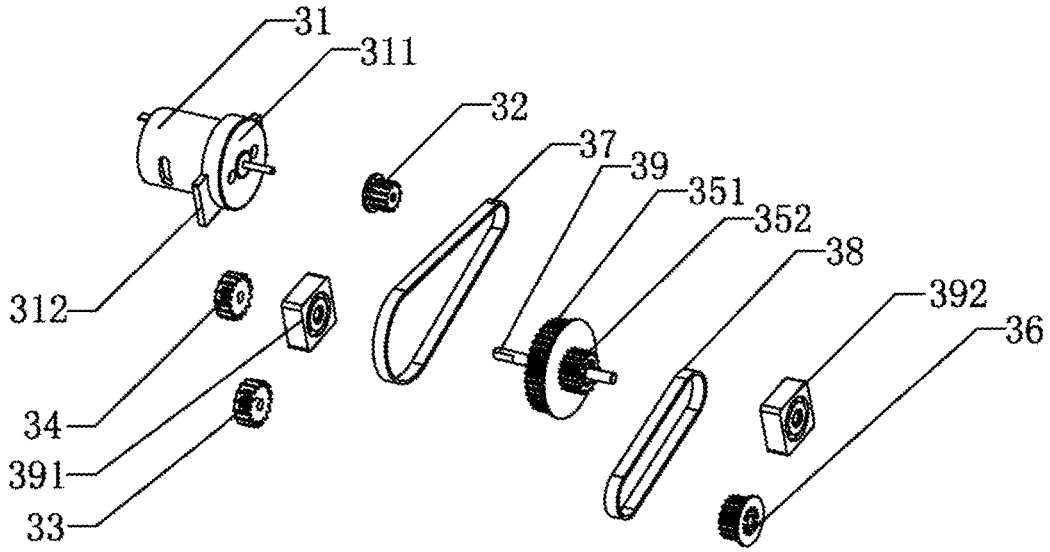
FIG. 11 is a schematic structural perspective exploded view of the drive mechanism of the cleaning appliance provided by the present invention.
Figure 12:
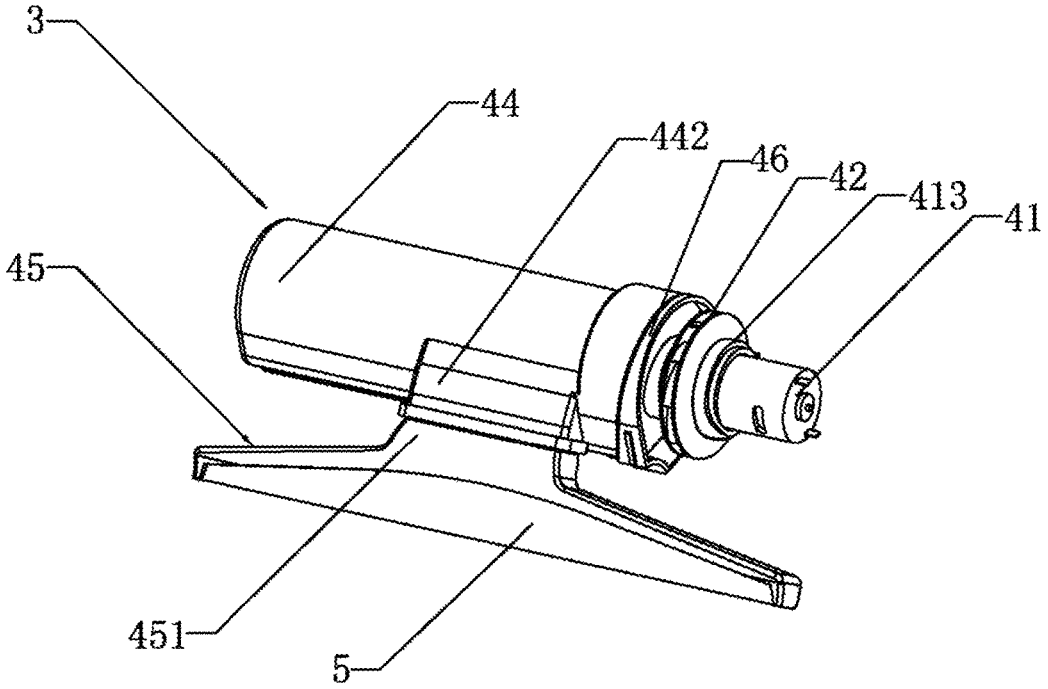
FIG. 12 is a schematic structural perspective view of a dust collector of the cleaning appliance provided by the present invention.
Figure 13:
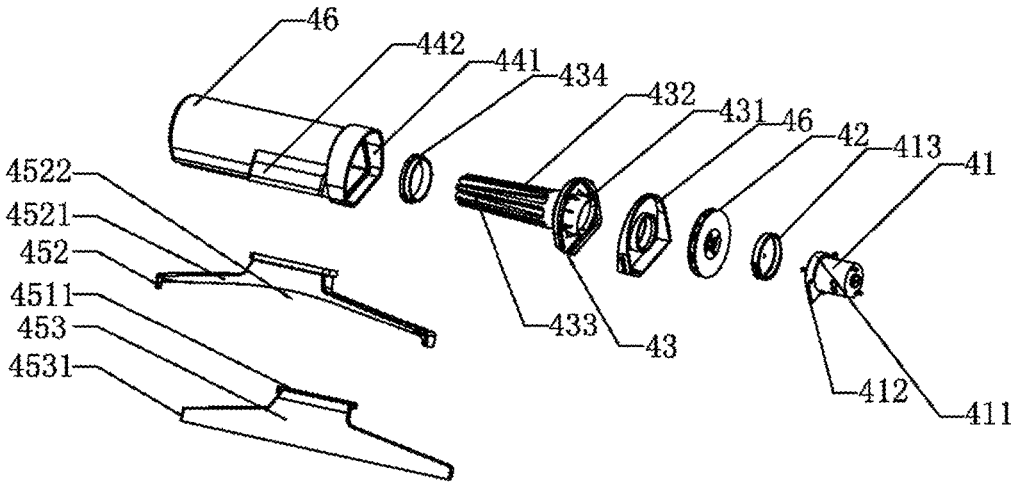
FIG. 13 is a schematic structural perspective exploded view of the dust collector of the cleaning appliance provided by the present invention.

In order to facilitate the understanding of those skilled in the art, further description will be given below to the present invention with reference to the embodiments and FIGS. 1 to 14. The content involved in the embodiments is not intended to limit the present invention.

Embodiment 1

FIGS. 1 to 13 illustrate the embodiment 1 of the cleaning appliance provided by the present invention, which comprises a cleaning appliance body. The cleaning appliance body includes a housing 1, two brush rollers 2 disposed at the bottom of the housing 1, a drive mechanism 3 disposed in the housing 1 and configured to drive the two brush rollers 2 to rotate, and a dust collector 4 disposed on the housing 1. A suction port 5 of the dust collector 4 is disposed between the two brush rollers 2. Both rotation directions of the two brush rollers 2 direct towards the suction port 5.

The number of the suction port 5 may also be two or more than two as long as waste can be sucked into the dust collector 4 from the suction port 5. Any apparent replacement made without departing from the concept of the present invention shall fall within the scope of protection of the present invention.

The cleaning appliance provided by the present invention adopts a combined structure of the two brush rollers 2 and the dust collector 4; both rotation directions of the two brush rollers 2 direct towards the suction port 5; dust, particulate waste or flocks are gathered; the waste is sucked into the dust collector 4 through the suction port 5 between the two brush rollers 2; and hence the one-time rapid and neat cleaning effect can be achieved. Moreover, dust, other particulate waste or flocks on the floor are all cleaned once and dust lines will not be retained on the floor, so that the labor intensity can be greatly reduced.

In the embodiment, the two brush rollers 2 are a first brush roller 21 and a second brush roller 22 which are parallel to each other; two rows of brushes 23 are fixed on both outer walls of the first brush roller 21 and the second brush roller 22; and the two rows of brushes 23 of each brush roller 2 are wavy and arranged opposite to each other. As the two rows of brushes 23 of each brush roller 2 are wavy and arranged opposite to each other, dust, particulate waste or flocks can be quickly gathered by utilization of the rotation directions of the two brush rollers 2, and hence the cleaning efficiency can be improved.

In the embodiment, the housing 1 includes an upper housing 11 and a lower housing 12; a first brush roller mounting groove 121 is recessed upwards in a central section of the lower housing 12; the first brush roller 21 is disposed in the first brush roller mounting groove 121; a second brush roller mounting portion 111 is projected upwards at a front end of the upper housing 11; a second brush roller mounting port 122 is disposed at a front end of the lower housing 12; a central section of the second brush roller 22 is disposed in the second brush roller mounting port 122; and the top of the second brush roller 22 is disposed in the second brush roller mounting portion 111. Due to the arrangement of the first brush roller mounting groove 121, the second brush roller mounting port 122 and the second brush roller mounting portion 111, the cleaning appliance provided by the present invention has the advantages of greatly reduced volume, reasonably utilized space and simple structure.

A first left roller shaft 211 and a first right roller shaft 212 are respectively projected at both ends of the first brush roller 21; a first clamping projection 213 is respectively disposed at one end of the first left roller shaft 211 and one end of the first right roller shaft 212; a first recess 214 is respectively disposed at both ends of the first brush roller 21; the first clamping projection 213 is clamped into the first recess 214; and the other end of the first left roller shaft 211 and the other end of the first right roller shaft 212 are respectively rotationally connected to both ends of the first brush roller mounting groove 121. The first left roller shaft 211 and the first right roller shaft 212 are configured to rotate the first brush roller 21. The clamping arrangement of the first clamping projection 213 and the first recess 214 is conducive to more convenient assembly and disassembly of the first left roller shaft 211 and the first right roller shaft 212.

A second left roller shaft 221 and a second right roller shaft 222 are respectively projected at both ends of the second brush roller 22; a second clamping projection 223 is respectively disposed at one end of the second left roller shaft 221 and one end of the second right roller shaft 222; a second recess 224 is respectively disposed at both ends of the second brush roller 22; the second clamping projection 223 is clamped into the second recess 224; and the other end of the second left roller shaft 221 and the other end of the second right roller shaft 222 are respectively rotationally connected to both ends of the second brush roller mounting port 122. The second left roller shaft 221 and the second right roller shaft 222 are configured to rotate the second brush roller 22. The clamping arrangement of the second clamping projection 223 and the second recess 224 is conducive to more convenient assembly and disassembly of the second left roller shaft 221 and the second right roller shaft 222.

In the embodiment, the drive mechanism 3 includes a first motor 31 and an actuating mechanism; and the actuating mechanism includes an output gear 32 fixed at an output end of the first motor 31, a first gear 33 fixed on the first right roller shaft 212, a reverse gear 34 engaged with the first gear 33, a duplicate gear 35 fixed coaxially with the reverse gear 34, a second gear 36 fixed on the second right roller shaft 222, a first belt 37 connected between the output gear 32 and the duplicate gear 35, and a second belt 38 connected between the duplicate gear 35 and the second gear 36. When the cleaning appliance provided by the present invention is used, the motor drives the output gear 32 to rotate; the output gear 32 drives the duplicate gear 35 to rotate through the first belt 37; the duplicate gear 35 drives the second gear 36 to rotate through the second belt 38; and the second gear 36 drives the second right roller shaft 222 to rotate and hence drives the second brush roller 22 to rotate. In addition, when the duplicate gear 35 rotates, the duplicate gear 35 drives the reverse gear 34, coaxially fixed with the duplicate gear 35, to rotate; the reverse gear 34 drives the first gear 33 to rotate oppositely; and the first gear 33 drives the first right roller shaft 212 to rotate and hence drives the second brush roller 21 to rotate.

In the cleaning appliance provided by the present invention, as the two brush rollers 2 with different rotation directions are driven by the same first motor 31, namely different rotation directions are achieved by gear engagement and belt engagement, the production cost can be reduced. The cleaning appliance provided by the present invention may also adopt two first motors 31 to respectively drive the first brush roller 21 and the second brush roller 22 to achieve different rotation directions. The drive mechanism 3 for driving the two brush rollers 2 to rotate of cleaning appliance provided by the present invention may also be achieved by other means. Any apparent replacement made without departing from the concept of the present invention shall fall within the scope of protection of the present invention.

The duplicate gear 35 includes a first single gear 351 and a second single gear 352; the diameter of the first single gear 351 is greater than that of the second single gear 352; the first single gear 351 and the output gear 32 are transmissibly connected with each other through the first gear 37; and the second single gear 352 and the second gear 36 are transmissibly connected with each other through the second belt 38. For the cleaning appliance provided by the present invention to achieve optimum use effect, the ratio of the diameter of a top circle of the first single gear 351 to the diameter of a top circle of the second single gear 352 is 1.8-2.5:1; the diameter of the top circle of the second single gear 352 is equal to the diameter of a top circle of the second gear 36; the diameter of a top circle of the reverse gear 34 is greater than the diameter of the top circle of the second single gear 352 and less than the diameter of the top circle of the first single gear 351; the diameter of a top circle of the first gear 33 is equal to the diameter of a top circle of the reverse gear 34; and the ratio of the diameter of a top circle of the output gear 32 to the diameter of the top circle of the second single gear 352 is 0.6-0.8:1.

In the embodiment, a first motor cover 311 is covered at one end of the first motor 31; a first protrusion 312 is respectively fixed on both sides of the first motor cover 311; a first holder 123 is fixed at a position of the top of the lower housing 12, corresponding to the first protrusion 312, and is provided with a first clamping groove 1231 engaged with the first protrusion 312; and the first protrusion 312 is clamped with the first clamping groove 1231. The arrangement of the first motor cover 311 is conducive to the mounting and fixing of the first motor 31. The clamping arrangement of the first protrusion 312 and the first clamping groove 1231 is conducive to more convenient assembly and disassembly of the first motor 31.

A first left bearing support 2111 and a first right bearing support 2121 are respectively sleeved on outer walls of the first left roller shaft 211 and the first right roller shaft 212; a first left fixing groove 1211 and a first right fixing groove 1212 are respectively disposed at both ends of the first brush roller mounting groove 121; the first left bearing support 2111 and the first right bearing support 2121 are respectively embedded into the first left fixing groove 1211 and the first right fixing groove 1212; a first left fixing plate 1213 is fixed at the bottom of the first left fixing groove 1211; a receiving groove 1214 is disposed on one side of the first right fixing groove 1212; the first gear 33 is embedded into the receiving groove 1214; and a first right fixing plate 1215 is fixed at the bottom of the receiving groove 1214 and the first right fixing groove 1212. The first left bearing support 2111 and the first right bearing support 2121 are configured to rotate the first brush roller 21. Due to the arrangement of the first left fixing plate 1213 and the first right fixing plate 1215, the movement of the first left bearing support 2111 and the first right bearing support 2121 can be prevented, and hence the rotation of the first brush roller 21 can be more stable.

A second left bearing support 2211 and a second right bearing support 2221 are respectively sleeved on outer walls of the second left roller shaft 221 and the second right roller shaft 222; a second left fixing groove 1221 and a second right fixing groove 1222 are respectively disposed at both ends of the second brush roller mounting port 122; and the second left bearing support 2211 and the second right bearing support 2221 are respectively embedded into the second left fixing groove 1221 and the second right fixing groove 1222. The second left bearing support 2211 and the second right bearing support 2221 are configured to rotate the second brush roller 22.

The reverse gear 34 and the duplicate gear 35 are fixedly connected with each other through a connecting shaft 39; a third left bearing support 391 is sleeved on an outer wall of the connecting shaft 39 and disposed between the reverse gear 34 and the duplicate gear 35; the other end of the connecting shaft 39 runs through the duplicate gear 35 and is extended; a third right bearing support 392 is sleeved on an outer wall of an extension of the connecting shaft 39; a third left fixing groove 124 and a third right fixing groove 125 are respectively disposed on the top of the lower housing 12, corresponding to the third left bearing support 391 and the third right bearing support 392; and the third left bearing support 391 and the third right bearing support 392 are respectively embedded into the third left fixing groove 124 and the third right fixing groove 125. The third left bearing support 391 and the third right bearing support 392 are configured to rotate the connecting shaft 39.

In the embodiment, the dust collector 4 includes a second motor 41, a fan 42 fixed at an output end of the second motor 41, a filter 43 connected to one end of the fan 42, a dust collection bucket 44 being sleeved on the outside of the filter 43 and having a hollow inner structure, and a dust collection handle 45 disposed on the outside of the dust collection bucket 44 and communicated with the inside of the dust collection bucket 44. When the cleaning appliance provided by the present invention is used, the second motor 41 drives the fan 42 to rotate so as to generate suction, and hence waste is sucked into the dust collection bucket 44 through the dust collection handle 45.

The second motor 41 and the first motor 31 may share one motor, e.g., a dual-output motor. Any apparent replacement made without departing from the concept of the present invention shall fall within the scope of protection of the present invention.

In the embodiment, a second motor cover 411 is covered at one end of the second motor 41; a second protrusion 412 is respectively fixed on both sides of the second motor cover 411; a second holder 126 is fixed at a position of the top of the lower housing 12, corresponding to the second protrusion 412, and is provided with a second clamping groove 1261 engaged with the second protrusion 412; the second protrusion 412 is clamped with the second clamping groove 1261; and a washer 413 is sleeved at one end of the second motor cover 411. The arrangement of the second motor cover 411 is conducive to the mounting and fixing of the second motor 41. The clamping arrangement of the second protrusion 412 and the second clamping groove 1261 is conducive to more convenient assembly and disassembly of the second motor 41.

A dust collection bucket holder 46 is fixed at one end of the dust collection bucket 44. One end of the dust collection bucket 44 and one end of the fan 42 are respectively fixed at both ends of the dust collection bucket holder 46. The dust collection bucket holder 46 is configured to fix the dust collection bucket 44 and the fan 42.

A dust collection bucket mounting port 112 is disposed in a central section of the upper housing 11; a dust collection bucket 44 is disposed in the dust collection bucket mounting port 112; a fan mounting portion 113 and a second motor mounting portion 114 are projected in the central section of the upper housing 11; the top of the fan 42 is disposed in the fan mounting portion 113; the fan mounting portion 113 is cambered; a plurality of vents 1131 are uniformly formed on a surface of the fan mounting portion 113; and the top of the second motor 41 is disposed in the second motor mounting portion 114. Due to the arrangement of the dust collection bucket mounting port 112, the fan mounting portion 113 and the second motor mounting portion 114, the cleaning appliance provided by the present invention has the advantages of greatly reduced volume, reasonably utilized space and simple structure.

The filter 43 includes a fixing portion 431 and an extension 432 projected at one end of the fixing portion 431; an annular groove 441 engaged with the fixing portion 431 is disposed at one end of the dust collection bucket 44; the outside of the fixing portion 431 is embedded into the annular groove 441; a plurality of strip holes 433 are uniformly formed on an outer wall of the extension 432; and a filter ring 434 is sleeved at a connection between the fixing portion 431 and the extension 432. An inserting portion is projected at one end of the filter ring 434; the fixing portion 431 is provided with an inserting groove engaged with the inserting portion; and the inserting portion is embedded into the inserting groove. The arrangement of the fixing portion 431 and the annular groove 441 is conducive to the mounting and fixing of the filter 43. The arrangement of the inserting portion and the inserting groove is conducive to the assembly and disassembly of the filter ring.

In the embodiment, the dust collection handle 45 is in the shape of a clothes hanger; a first connecting portion 451 is projected on the top of the dust collection handle 45 and provided with a connecting groove 4511; a second connecting portion 442 is projected on an outer wall of the dust collection bucket 44; the bottom of the first connecting portion 451 is inserted into the connecting groove 4511; and the first connecting portion 451 and the second connecting portion 442 have a hollow inner structure respectively and are communicated with each other. The arrangement of the first connecting portion 451 and the connecting groove 4511 is conducive to the assembly and disassembly of the dust collection handle 45.

The dust collection handle 45 includes an upper dust collection handle 452 and a lower dust collection handle 453; a third clamping projection 4531 is respectively fixed on the left, the rear and the right of the lower dust collection handle 453; a third clamping groove 4521 engaged with the third clamping projection 4531 is respectively disposed on the left, the rear and the right of the upper dust collection handle 452; the third clamping projection 4531 is clamped with the third clamping groove 4521; the suction port 5 is formed between front ends of the lower dust collection handle 453 and the upper dust collection handle 452; and an arc gap 4522 is disposed at a front end of the upper dust collection handle 452. The clamping arrangement of the third clamping projection 4531 and the third clamping groove 4521 is conducive to the assembly and disassembly of the upper dust collection handle 452 and the lower dust collection handle 453. Due to the arrangement of the arc gap 4522, the vacuum of the suction port 5 can be increased and the cleaning efficiency can be improved.

In the embodiment, a handle connector 115 for mounting the handle is disposed at the rear of the upper hosing 11; and a roller wheel 127 is disposed at a front end of the bottom of the lower housing 12. The handle connector 115 may be configured to mount the handle and is convenient to use. The arrangement of the roller wheel 127 is conducive to the movement of the cleaning appliance provided by the present invention.

Embodiment 2

Figure 14:
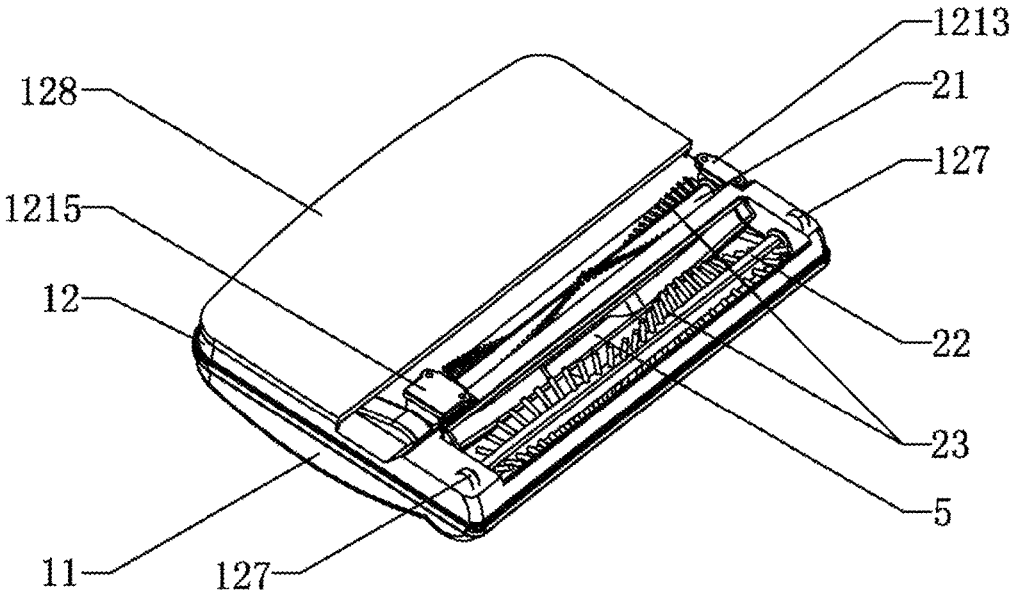
FIG. 14 is a schematic structural perspective view of the cleaning appliance provided by the embodiment 2 of the present invention.

FIG. 14 illustrates the embodiment 2 of the cleaning appliance provided by the present invention. The difference from the embodiment 1 is as follows: a cushion body 128 is disposed at the rear of the bottom of the lower housing 12 and is a cloth cushion or a paper cushion; and the cloth cushion is a steam spray cloth cushion, a water spray cloth cushion or a disinfecting fluid spray cloth cushion. More specifically, a cushion body receiving groove is disposed at the rear of the bottom of the lower housing 12, and the cushion body 128 is embedded into the cushion body receiving groove. The cleaning appliance provided by the present invention may also adopt a combined structure of two brush rollers 2, a dust collector 4 and a cloth cushion. The cloth cushion may be sprayed with high-temperature steam, water or other disinfecting fluid, so that the cleaning efficiency can be improved.

The cleaning appliance provided by the present invention can be widely applied in electrical floor cleaning appliances, can become an independent cleaning appliance, and can also be combined into a two-in-one cleaning appliance with an appliance with steam spray floor washing function. The appliance with the steam spray floor washing function and the cleaning appliance provided by the present invention can be simultaneously or independently used. The cleaning appliance provided by the present invention can also be combined into a two-in-one cleaning appliance with an appliance with high-temperature steam, water or other disinfecting fluid spray floor washing function. The appliance with the high-temperature steam, water or other disinfecting fluid spray floor washing function and the cleaning appliance provided by the present invention can be simultaneously or independently used. The cleaning appliance provided by the present invention can also be combined into a cleaning appliance with a cloth cushion or a paper cushion.

The above embodiments are preferred embodiments of the present invention. In addition, the present invention may also be implemented by other means. Any apparent replacement made without departing from the concept of the present invention shall fall within the scope of protection of the present invention.

What is claimed is:

1. A cleaning appliance comprising:

a cleaning appliance body;

the cleaning appliance body comprising a housing, two brush rollers disposed at a bottom of the housing, a drive mechanism disposed in the housing and configured to drive the two brush rollers to rotate, and a dust collector disposed on the housing;

a suction port of the dust collector being disposed between the two brush rollers;

both rotation directions of the two brush rollers directing towards the suction port;

the two brush rollers being a first brush roller and a second brush roller parallel to each other;

two rows of brushes being fixed on outer walls of both the first brush roller and the second brush roller;

the two rows of brushes of each of the two brush rollers being wavy and arranged opposite to each other;

the housing comprising an upper housing and a lower housing;

a first brush roller mounting groove being recessed upwards in a central section of the lower housing;

the first brush roller being disposed in the first brush roller mounting groove;

a second brush roller mounting portion being projected upwards at a front end of the upper housing;

a second brush roller mounting port being disposed at a front end of the lower housing;

a central section of the second brush roller being disposed in the second brush roller mounting port;

a top of the second brush roller being disposed in the second brush roller mounting portion;

a first left roller shaft and a first right roller shaft being respectively projected at both ends of the first brush roller;

a first clamping projection being respectively disposed at one end of the first left roller shaft and one end of the first right roller shaft;

a first recess being respectively disposed at both ends of the first brush roller;

the first clamping projection being clamped into the first recess;

the other end of the first left roller shaft and the other end of the first right roller shaft being respectively rotationally connected to both ends of the first brush roller mounting groove;

a second left roller shaft and a second right roller shaft being respectively projected at both ends of the second brush roller;

a second clamping projection being respectively disposed at one end of the second left roller shaft and one end of the second right roller shaft;

a second recess being respectively disposed at both ends of the second brush roller;

the second clamping projection being clamped into the second recess; and the other end of the second left roller shaft and the other end of the second right roller shaft being respectively rotationally connected to both ends of the second brush roller mounting port.

2. The cleaning appliance according to claim 1, wherein the drive mechanism includes a first motor and an actuating mechanism; the actuating mechanism includes an output gear fixed at an output end of the first motor, a first gear fixed on the first right roller shaft, a reverse gear engaged with the first gear, a duplicate gear fixed coaxially with the reverse gear, a second gear fixed on the second right roller shaft, a first belt connected between the output gear and the duplicate gear, and a second belt connected between the duplicate gear and the second gear;

the duplicate gear includes a first single gear and a second single gear; the diameter of the first single gear is greater than that of the second single gear; the first single gear and the output gear are transmissibly connected with each other through the first gear;

and the second single gear and the second gear are transmissibly connected with each other through the second belt.

3. The cleaning appliance according to claim 2, wherein a first motor cover is covered at one end of the first motor; a first protrusion is respectively fixed on both sides of the first motor cover; a first holder is fixed at a position of the top of the lower housing, corresponding to the first protrusion, and is provided with a first clamping groove engaged with the first protrusion; the first protrusion is clamped with the first clamping groove;

a first left bearing support and a first right bearing support are respectively sleeved on outer walls of the first left roller shaft and the first right roller shaft; a first left fixing groove and a first right fixing groove are respectively disposed at both ends of the first brush roller mounting groove; the first left bearing support and the first right bearing support are respectively embedded into the first left fixing groove and the first right fixing groove; a first left fixing plate is fixed at the bottom of the first left fixing groove; a receiving groove is disposed on one side of the first right fixing groove; the first gear is embedded into the receiving groove; a first right fixing plate is fixed at the bottom of the receiving groove and the first right fixing groove;

a second left bearing support and a second right bearing support are respectively sleeved on outer walls of the second left roller shaft and the second right roller shaft; a second left fixing groove and a second right fixing groove are respectively disposed at both ends of the second brush roller mounting port; the second left bearing support and the second right bearing support are respectively embedded into the second left fixing groove and the second right fixing groove;

the reverse gear and the duplicate gear are fixedly connected with each other through a connecting shaft; a third left bearing support is sleeved on an outer wall of the connecting shaft and disposed between the reverse gear and the duplicate gear; the other end of the connecting shaft runs through the duplicate gear and is extended; a third right bearing support is sleeved on an outer wall of an extension of the connecting shaft; a third left fixing groove and a third right fixing groove are respectively disposed on the top of the lower housing, corresponding to the third left bearing support and the third right bearing support; and the third left bearing support and the third right bearing support are respectively embedded into the third left fixing groove and the third right fixing groove.

4. The cleaning appliance according to claim 1, wherein the dust collector includes a second motor, a fan fixed at an output end of the second motor, a filter connected to one end of the fan, a dust collection bucket being sleeved on the outside of the filter and having a hollow inner structure, and a dust collection handle disposed on the outside of the dust collection bucket and communicated with the inside of the dust collection bucket.

5. The cleaning appliance according to claim 4, wherein a second motor cover is covered at one end of the second motor; a second protrusion is respectively fixed on both sides of the second motor cover; a second holder is fixed at a position of the top of the lower housing, corresponding to the second protrusion, and is provided with a second clamping groove engaged with the second protrusion; the second protrusion is clamped with the second clamping groove; a washer is sleeved at one end of the second motor cover;

a dust collection bucket holder is fixed at one end of the dust collection bucket; one end of the dust collection bucket and one end of the fan are respectively fixed at both ends of the dust collection bucket holder;

a dust collection bucket mounting port is disposed in a central section of the upper housing; a dust collection bucket is disposed in the dust collection bucket mounting port;

a fan mounting portion and a second motor mounting portion are projected in the central section of the upper housing; the top of the fan is disposed in the fan mounting portion; the fan mounting portion is cambered; a plurality of vents are uniformly formed on a surface of the fan mounting portion; the top of the second motor is disposed in the second motor mounting portion;

the filter includes a fixing portion and an extension projected at one end of the fixing portion; an annular groove engaged with the fixing portion is disposed at one end of the dust collection bucket; the outside of the fixing portion is embedded into the annular groove; a plurality of strip holes are uniformly formed on an outer wall of the extension; and a filter ring is sleeved at a connection between the fixing portion and the extension.

6. The cleaning appliance according to claim 4, wherein the dust collection handle is of triangular-shaped; a first connecting portion is projected on the top of the dust collection handle and provided with a connecting groove; a second connecting portion is projected on an outer wall of the dust collection bucket; the bottom of the first connecting portion is inserted into the connecting groove; the first connecting portion and the second connecting portion have a hollow inner structure respectively and are communicated with each other;

the dust collection handle includes an upper dust collection handle and a lower dust collection handle; a third clamping projection is respectively fixed on the left, the rear and the right of the lower dust collection handle; a third clamping groove engaged with the third clamping projection is respectively disposed on the left, the rear and the right of the upper dust collection handle; the third clamping projection is clamped with the third clamping groove; the suction port is formed between front ends of the lower dust collection handle and the upper dust collection handle; and an arc gap is disposed at a front end of the upper dust collection handle.

7. The cleaning appliance according to claim 1, wherein a handle connector for mounting a handle is disposed at the rear of the upper housing; and a roller wheel is disposed at a front end of the bottom of the lower housing.

8. The cleaning appliance according to claim 1, wherein a cushion body is disposed at the rear of the bottom of the lower housing and is a cloth cushion or a paper cushion; and the cloth cushion is a steam spray cloth cushion, a water spray cloth cushion or a disinfecting fluid spray cloth cushion.

* * * * *